US011879371B2

(12) United States Patent
Uysal et al.

(10) Patent No.: US 11,879,371 B2
(45) Date of Patent: Jan. 23, 2024

(54) HEATING CONDUCTOR FOR AN EXHAUST GAS HEATING ARRANGEMENT

(71) Applicant: Purem GmbH, Neunkirchen (DE)

(72) Inventors: Fatih Uysal, Plochingen (DE); Enver Kurpejovic, Kirchheim unter Teck (DE); Klaus Tüber, Esslingen (DE); Sandra Höckel, Esslingen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 17/722,067

(22) Filed: Apr. 15, 2022

(65) Prior Publication Data

US 2022/0333517 A1 Oct. 20, 2022

(30) Foreign Application Priority Data

Apr. 16, 2021 (DE) ..... 10 2021 109 567.0

(51) Int. Cl.
*F01N 3/00* (2006.01)
*F01N 3/20* (2006.01)

(52) U.S. Cl.
CPC ..... *F01N 3/2013* (2013.01); *F01N 2240/16* (2013.01)

(58) Field of Classification Search
CPC .. F01N 3/2013; F01N 2240/16; F01N 3/2892; F01N 2240/20; F01N 2330/40; F01N 3/027; F01N 13/1872; H05B 2203/003
See application file for complete search history.

(56) References Cited

U.S. PATENT DOCUMENTS 4,671,058 A 6/1987 Yoshida et al.
4,723,973 A * 2/1988 Oyobe ..... F01N 3/027 60/303
5,633,073 A 5/1997 Cheung et al.
2003/0051665 A1 3/2003 Zhao et al.
2014/0190151 A1* 7/2014 Culbertson ..... H05B 3/44 60/303
2015/0152766 A1* 6/2015 Brunel ..... F01N 3/2066 422/148
2015/0315943 A1* 11/2015 Gschwind ..... B01F 27/053 422/180
2017/0273146 A1 9/2017 Everly et al.
(Continued)

FOREIGN PATENT DOCUMENTS

DE 10 2020 123 376 A1 3/2022
EP 0 608 783 A1 8/1994
(Continued)

OTHER PUBLICATIONS

Examination Report of the Intellectual Property India office dated Jan. 11, 2023 in corresponding Indian patent application 202234020174.

*Primary Examiner* — Matthew T Largi
(74) *Attorney, Agent, or Firm* — Walter Ottesen, P.A.

(57) ABSTRACT

A heating conductor for an exhaust gas heating arrangement for an exhaust gas system for an internal combustion engine includes a plurality of heating conductor sections. At least one throughflow opening, preferably a plurality of throughflow openings through which exhaust gas can flow, is or are provided in at least one heating conductor section, preferably in a plurality of heating conductor sections or in each heating conductor section.

8 Claims, 4 Drawing Sheets

(56) References Cited

U.S. PATENT DOCUMENTS

| | | | | |
|---|---|---|---|---|
| 2018/0371978 | A1* | 12/2018 | Sampath | F01N 5/025 |
| 2020/0072107 | A1* | 3/2020 | Aufranc | F01N 3/2013 |
| 2020/0109652 | A1 | 4/2020 | Aufranc et al. | |
| 2020/0284179 | A1* | 9/2020 | Swanson | F01N 11/005 |
| 2020/0300141 | A1* | 9/2020 | Gaiser | F01N 13/14 |
| 2022/0074333 | A1 | 3/2022 | Hoeckel et al. | |

FOREIGN PATENT DOCUMENTS

| | | | |
|---|---|---|---|
| EP | 1 484 484 | A1 | 12/2004 |
| JP | S60-130084 | A | 7/1985 |
| JP | H08-218856 | A | 8/1996 |
| JP | 2002-509989 | A | 4/2002 |
| JP | 4485681 | A | 4/2002 |
| JP | 2004-152912 | A | 5/2004 |
| JP | 2004-267959 | A | 9/2004 |
| JP | 2009-043470 | A | 2/2009 |
| JP | 2016-503854 | A | 2/2016 |
| JP | 2019-510343 | A | 4/2019 |
| WO | 99/50475 | A1 | 10/1999 |
| WO | 2014/086440 | A1 | 6/2014 |

* cited by examiner

HEATING CONDUCTOR FOR AN EXHAUST GAS HEATING ARRANGEMENT

CROSS REFERENCE TO RELATED APPLICATION

This application claims priority of German patent application no. 10 2021 109 567.0, filed Apr. 16, 2021, the entire content of which is incorporated herein by reference.

TECHNICAL FIELD

The present disclosure relates to a heating conductor for an exhaust gas heating arrangement for an exhaust gas system for an internal combustion engine.

BACKGROUND

An exhaust gas heating arrangement having a heating conductor formed by cutting out from a metal flat material is known from US 2022/0074333 (the entirety of which is incorporated by reference herein). By providing the heating conductor, which is carried between two carrier elements, by cutting it out from a metal flat material, for example by cutting or punching such a heating conductor out of a plate-like blank of the metal flat material, it is possible to provide such a heating conductor with virtually any comparatively complex profile, and in particular also with a varying cross-sectional area, and thus also with a locally varying resistance of various heating conductor sections, and therefore to adapt the heating conductor to the flow conditions present in an exhaust gas conducting housing of an exhaust gas system.

SUMMARY

It is an object of the present disclosure to provide a heating conductor for an exhaust gas heating arrangement for an exhaust gas system of an internal combustion engine, which heating conductor has increased efficiency in transmitting heat to exhaust gas flowing through it.

According to the disclosure, this object is achieved by a heating conductor for an exhaust gas heating arrangement for an exhaust gas system for an internal combustion engine, including a plurality of heating conductor sections, wherein at least one throughflow opening, preferably a plurality of throughflow openings through which exhaust gas can flow is or are provided in at least one heating conductor section, preferably in a plurality of heating conductor sections or in each heating conductor section.

By providing one or more throughflow openings in at least one portion of the heating conductor sections of the heating conductor, that is, in at least one of the heating conductor sections of the heating conductor, a substantial influence on the flow conditions in an exhaust gas system is achieved. Owing to the throughflow openings, the counter pressure produced by such a heating conductor as exhaust gas flows through it is lower than in an approximately identically dimensioned heating conductor without throughflow openings. Exhaust gas can flow better around the heating conductor itself and, also depending on the geometry of such throughflow openings, in a larger surface area, and therefore an increased transmission of heat to exhaust gas flowing around the heating conductor can be achieved. Since, during the heating operation, electrical current flows through the heating conductor and, in the region of a respective throughflow opening, current flow paths having an electrical resistance which is dependent on the cross-sectional geometry of the throughflow opening are formed on either side of such a throughflow opening, local influencing or stipulating of the current flow makes it possible to adapt the heat transmission behavior to respective flow conditions in an exhaust gas system of an internal combustion engine.

The heating conductor through which a current flows can have a large length advantageous for efficient heat transmission by the fact that at least one portion of the heating conductor sections is arranged adjoining one another in order to provide a structure of the heating conductor extending in the manner of a winding.

For this purpose, it can be provided, for example, that at least one portion of the heating conductor sections forms a structure of the heating conductor wound at least in regions in a meandering manner. The individual heating conductor sections together forming the meandering structure can each be formed individually in a manner extending substantially rectilinearly or in a curved manner.

Furthermore, for the heating conductor to have a comparatively large length, at least one portion of the heating conductor sections can form a structure of the heating conductor wound at least in regions spirally. In the case of such a spirally wound structure of the heating conductor, the heating conductor sections can be provided by, for example, winding sections each extending over an angle of approximately 360°.

Since the individual heating conductor sections of the heating conductor are generally elongate substantially in a longitudinal direction of the heating conductor section, it can be provided, for a large cross-sectional area of a respective throughflow opening, that at least one throughflow opening, preferably a portion of the throughflow openings or each throughflow opening, is or are elongate in a longitudinal direction of the heating conductor section.

For further influencing of the flow conduction with a simultaneously large heat transmission surface, a flow-conducting element can be provided in association with at least one throughflow opening, preferably a portion of the throughflow openings or each throughflow opening, on the heating conductor.

For this purpose, at least at one throughflow opening, preferably at a portion of the throughflow openings or at each throughflow opening, the associated flow-conducting element can extend from a longitudinal end region of the throughflow opening in a longitudinal direction of the throughflow opening beyond the throughflow opening at least in regions.

For a structure which can be produced particularly simply and cost-effectively and acts reliably during operation, the heating conductor can be substantially plate-like or/and can be provided by cutting it out from a metal flat material, for example 2.4869, 14765 or 1.4725.

In order to influence the flow and in order to open up a respective throughflow opening for exhaust gas to flow through, at least at one throughflow opening, preferably at a portion of the throughflow openings or at each throughflow opening, the associated flow-conducting element can be offset at least in regions with respect to the heating conductor.

For a structure which can be produced particularly simply and cost-effectively and acts reliably during operation, the heating conductor can be substantially plate-like or/and can be provided by cutting it out from a metal flat material.

The disclosure further relates to a method for producing a heating conductor for an exhaust gas heating arrangement for an exhaust gas system for an internal combustion engine, including the measures of:

a) providing a metal flat material blank, b) cutting out at least one heating conductor having a plurality of heating conductor sections from the metal flat material blank, c) providing at least one throughflow opening, preferably a plurality of throughflow openings, in at least one heating conductor section of at least one heating conductor.

In measure b), at least one heating conductor, preferably each heating conductor, can be cut out from the metal flat material blank in a particularly simple manner by punching or cutting, for example by laser beam cutting or water jet cutting.

For rapidly, yet precisely carrying out the method according to the disclosure, in association with at least one heating conductor, preferably with each heating conductor, measure c) can be carried out as measure b) is being carried out, in order to provide at least one throughflow opening, preferably a portion of the throughflow openings or all the throughflow openings. For example, whenever one or more heating conductors is or are produced from the metal flat material blank by punching, the measure for producing one or more throughflow openings by punching can also be carried out. If, while simultaneously carrying out measures b) and c), the heating conductors are produced by cutting, one or more throughflow openings can also be produced with the same machining measure.

In particular whenever, in measure b), a heating conductor is to be provided with very finely structured heating conductor sections, or/and, in measure c), one or more throughflow openings with a very fine structure is or are to be provided in respective heating conductor sections, in association with at least one heating conductor, preferably with each heating conductor, measure c) can be carried out before measure b) is carried out, in order to provide at least one throughflow opening, preferably a portion of the throughflow openings or all the throughflow openings. Such throughflow openings are therefore produced in the comparatively stable metal flat material blank before the heating conductor or the heating conductors is or are cut out from the metal flat material blank with the throughflow openings which are then already present. This procedure is therefore also particularly advantageous since, after the heating conductors are cut out from the metal flat material blank, essentially no further machining steps have to be carried out for producing throughflow openings on the separated heating conductors.

In a further procedure, in association with at least one heating conductor, preferably with each heating conductor, measure c) can be carried out after measure b) is carried out, in order to provide at least one throughflow opening, preferably a plurality of or all the throughflow openings.

In particular whenever measures b) and c) are not carried out simultaneously, in association with at least one heating conductor, preferably with each heating conductor, measures b) and c) can be carried out with different machining measures from one another, in order to provide at least one throughflow opening, preferably a portion of the throughflow openings or each throughflow opening. This makes it possible to use an optimum machining measure for each of the measures.

In association with at least one heating conductor, preferably with each heating conductor, a flow-conducting element can be formed in measure c) in association with at least one throughflow opening, preferably a portion of the throughflow openings or all the throughflow openings.

The disclosure further relates to an exhaust gas heating arrangement for an exhaust gas system for an internal combustion engine, including a carrier arrangement and at least one heating conductor constructed according to the disclosure, preferably a plurality of heating conductors constructed according to the disclosure, preferably produced by a method according to the disclosure, the heating conductors following one another in a main flow direction of the exhaust gas and being carried by a carrier arrangement on an exhaust gas conducting housing.

The disclosure further relates to an exhaust gas system for an internal combustion engine, including at least one exhaust gas heating arrangement constructed according to the disclosure.

BRIEF DESCRIPTION OF THE DRAWINGS

The invention will now be described with reference to the drawings wherein.

DESCRIPTION OF THE PREFERRED EMBODIMENTS

Figure 1:
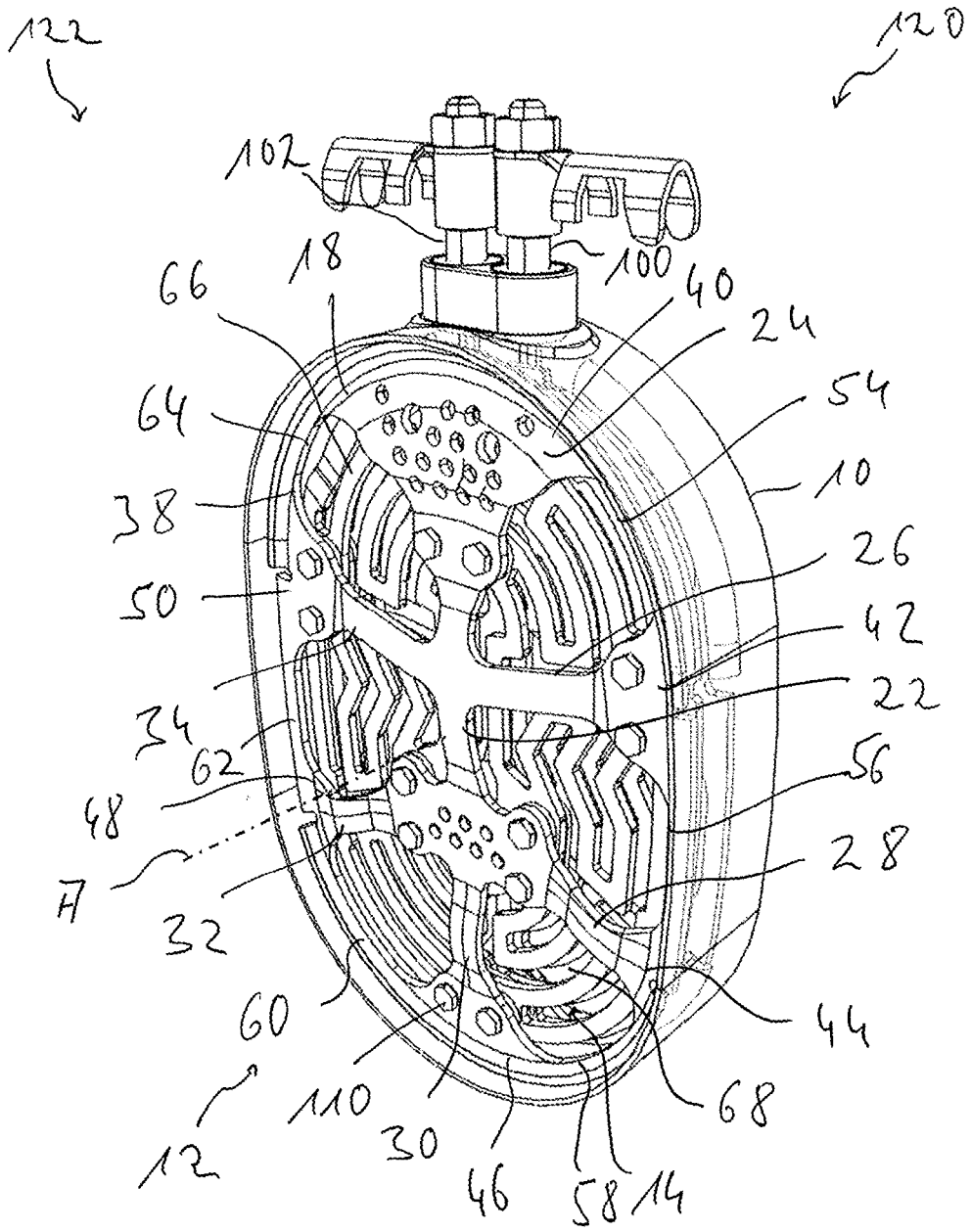
FIG. 1 shows a perspective view of an exhaust gas heater in an exhaust gas conducting housing.
Figure 2:
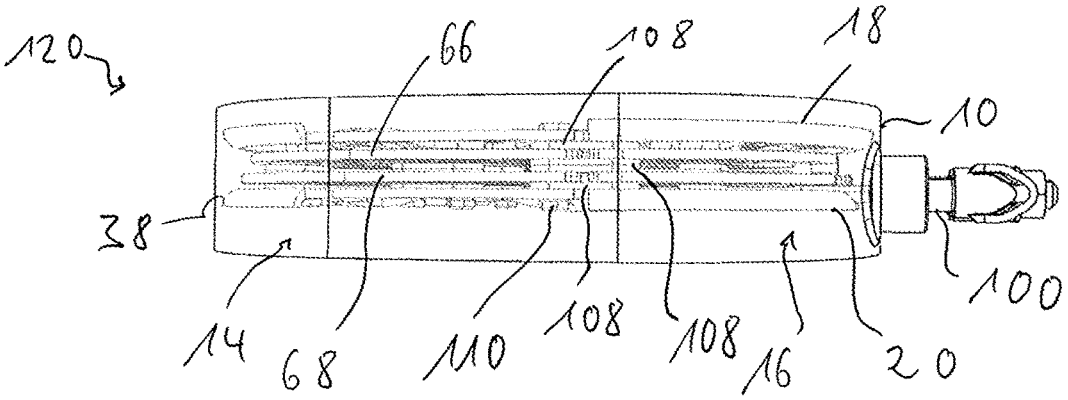
FIG. 2 shows a partial longitudinal sectional view of the exhaust gas heater inserted into the exhaust gas conducting housing.
Figure 3:
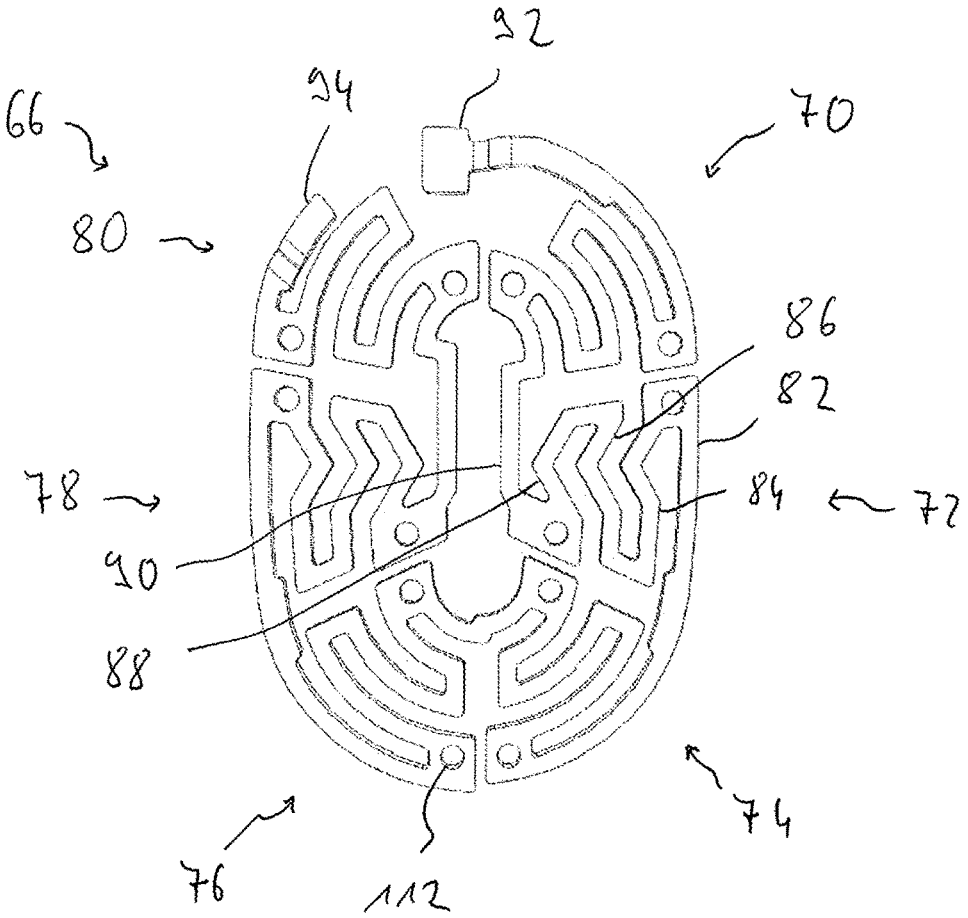
FIG. 3 shows a heating conductor of a heating conductor arrangement of the exhaust gas heater of FIG. 1.

FIGS. 1 to 3 show an embodiment of an exhaust gas heating arrangement 120 in an exhaust gas system 122 of an internal combustion engine, having an exhaust gas heater 12 which is inserted into, for example, a tubular exhaust gas conducting housing 10, which is elongate at least in sections in the direction of a center axis A of the exhaust gas heater. The exhaust gas heater 12 includes a heating conductor arrangement which is denoted in general by 14 and is carried by a carrier arrangement 16 on the exhaust gas conducting housing 10.

The carrier arrangement 16 includes two disk-like carrier elements 18, 20 which are formed, for example, from sheet metal material and are structurally identical to each other. The carrier elements 18, 20 are constructed with a central region 22 extending substantially transversely with respect to the center axis A of the exhaust gas heater and with a plurality of carrier arms 24, 26, 28, 30, 32, 34 extending in the direction radially outward from the central region 22. In an outer circumferential region of the carrier elements 18, 20, a fastening region, denoted in general by 38, is formed, with which the carrier elements 18, 20 and therefore the entire exhaust gas heater 12 can be secured on the inner surface of the exhaust gas conducting housing 10, for example by welding. In this fastening region 38, the two carrier elements 18, 20 are curved in the axial direction.

In the region of each of the carrier arms 24, 26, 28, 30, 32, 34, the fastening region 38 includes a respective fastening section 40, 42, 44, 46, 48, 50. Between two fastening sections 40, 42, 44, 46, 48, 50 in each case forming a radially outer end region of a carrier arm 24, 26, 28, 30, 32, 34, in each case one fastening edge 54, 56, 58, 60, 62, 64 connecting the fastening sections of two adjacent carrier arms is formed, and therefore the fastening sections 40, 42, 44, 46, 48, 50, with the fastening edges 54, 56, 58, 60, 62, 64 extending in between and connecting adjacent carrier arms 24, 26, 28, 30, 32, 34 to one another, provide a structure of the fastening region 38 that is substantially continuous in the circumferential direction.

Via the configuration of the carrier arms 24, 26, 28, 30, 32, 34 and also of the fastening region 38, a targeted flow conduction is achieved for the exhaust gas flowing through the exhaust gas heater 12. In particular, regions which are intended to be protected from a direct flow toward them can be covered by the carrier arms 24, 26, 28, 30, 32, 34. These may, for example, be regions in which sensors are arranged, for example, for detecting the temperature or for detecting the composition of the exhaust gas. Via the substantially annularly continuous fastening region 38, a flow is prevented in the radially outer region directly along a comparatively cold inner surface of an exhaust gas conducting housing 10 containing the exhaust gas heater 12.

FIG. 3 shows an upstream first heating conductor 66 of two heating conductors 66, 68, that are consecutive in the flow direction, of the heating conductor arrangement 14. Each of the two heating conductors 66, 68 which are basically not sheathed with electrically insulating material is provided by cutting each out from a metal flat material blank, for example by punching or cutting, for example laser cutting or water jet cutting, and has an outer circumferential contour which is adapted to the inner circumferential contour of the exhaust gas conducting housing 10 and, in the illustrated embodiment, is roundedly flattened. Each of the two heating conductors 66, 68 is constructed with a plurality of meandering winding fields 70, 72, 74, 76, 78, 80 following one another in the circumferential direction, wherein, in each of the meandering winding fields 70, 72, 74, 76, 78, 80, meandering winding sections, which provide heating conductor sections 82, 84, 86, 88, 90 staggered substantially radially with respect to one another and which are formed extending approximately in the circumferential direction, are provided. In one of their circumferential end regions, the meandering winding sections or heating conductor sections 84, 86, 88, 90 are each connected to a meandering winding section or heating conductor section 82, 84, 86, 88 positioned further radially outward. In their other circumferential end region, the meandering winding sections or heating conductor sections 82, 84, 86, 88 are each connected to a meandering winding section or heating conductor section 84, 86, 88, 90 lying further radially inward. The respective radially outer meandering winding sections or heating conductor sections 82 of the meandering winding fields 72, 74, 76, 78 connect directly mutually adjacent meandering winding fields to one another. Equally, the radially inner meandering winding sections or heating conductor sections 90 of the meandering winding fields 70, 72, 74, 76, 78, 80 connect directly mutually adjacent meandering winding fields, such that overall a serial electrical circuit of the meandering winding fields 70, 72, 74, 76, 78, 80 is obtained.

Although producing such heating conductors 66, 68 by cutting them out from a flat material gives rise to the possibility in a particularly simple and economic manner of providing the heating conductors 66, 68 with a comparatively complex structure of the meandering winding sections or heating conductor sections thereof, other production processes, such as, for example, metal injection molding or sintering, are in principle also possible for obtaining such heating conductors 66, 68.

The radially outer meandering winding sections or heating conductor sections 82 of the meandering winding fields 70, 80 of the first heating conductor 66 respectively provide a first connection region 92 and a second connection region 94 of the upstream first heating conductor 66. Equally, the radially outer meandering winding sections or heating conductor sections of the same meandering winding fields of the second heating conductor 68 provide a first connection region and a second connection region of the second heating conductor 68. With their first connection regions, the heating conductors 66, 68 each provide a voltage source connection region with which the heating conductors can be connected to a voltage source, for example via connection elements 100, 102 penetrating the exhaust gas conducting housing 10 in an electrically insulated and gas-tight manner. With their second connection regions, the two heating conductors 66, 68 provide contact connection regions in which the two heating conductors 66, 68 are interconnected in an electrically conducting manner, for example by a rivet bolt or welding or the like, such that, in this embodiment, an electrical serial circuit of the two heating conductors is produced. In the region of the connection regions, the heating conductors 66, 68 or the respective radially outer meandering winding sections or heating conductor sections 82 have a comparatively large width in order, because of the locally lower electrical resistance in these regions, which are shielded from exhaust gas flowing toward them, to reduce the generation of heat in comparison to the regions to which flow can be freely directed.

In an alternative configuration, for each of the heating conductors 66, 68, the second connection regions can also provide voltage source connection regions such that, for example, the two first connection regions of the two heating conductors 66, 68 can be connected to the connection element 100 and, via the latter, to a voltage source, while the second connection regions of the two heating conductors 66, 68 can be connected to each other and, via the connection element 102, to the voltage source, thus producing an electrically parallel circuit of the heating conductors 66, 68. In particular when a parallel circuit of the two heating conductors 66, 68 is selected, the heating conductors 66, 68 self-regulate if they are exposed to different exhaust gas temperatures, and locally different electrical resistances of the heating conductors 66, 68 thereby occur.

By the heating conductors 66, 68 lying one behind another in the direction of the center axis A of the exhaust gas heater and therefore also in a main flow direction of the exhaust gas, a comparatively large surface area for thermal interaction with the exhaust gas to be heated is achieved while the overall size is axially compact. In order to ensure that the second heating conductor 68, which is positioned further downstream, is not positioned completely in the flow shadow of the first heating conductor 66, which is positioned further upstream, the two heating conductors 66, 68 have non-identical structures or profiles of the individual meandering winding sections or heating conductor sections 82, 84, 86, 88. In the individual meandering winding fields 70, 72, 74, 76, 78, 80, the meandering winding sections or heating conductor sections 84, 86, 88 of the two heating conductors 66, 68 are in particular not completely congruent with each another, but rather are offset radially with respect to each another such that the second heating conductor 68, which is positioned further downstream, protrudes, at least in regions transversely with respect to the main flow direction H of the exhaust gas, beyond the first heating conductor 66, which is positioned further upstream. There is therefore virtually no cross-sectional region which is not covered by one of the two heating conductors 66, 68, and therefore, even taking into account the swirling or turbulence occurring as the flow passes through the two heating conductors 66, 68, a highly efficient and uniform heating of the exhaust gas flow is achieved. The radially outer meandering winding sections or heating conductor sections that are surrounded radially in regions by the fastening region 38 can be substantially congruent to one another. The radially inner meandering winding sections of the two heating conductors 66, 68 can also be congruent to one another.

For the fixed attachment to the carrier arrangement 16 or to the carrier elements 18, 20 thereof, a fixed assembly can be achieved in a plurality of fastening regions 106 by the carrier elements 18, 20 and by fastening bolts 110 passing through the latter and the heating conductors 66, 68 and also through insulating elements 108 positioned between the heating conductors 66, 68.

It should be pointed out that the basic configuration of an exhaust gas heating arrangement 120 has been described above with respect to FIGS. 1 to 3, in which configuration one or more heating conductors having the construction described below with respect to FIGS. 4 to 6 can be used. The overall structure of such an exhaust gas heating arrangement can differ in a wide variety of configuration aspects from the configuration described above with respect to FIGS. 1 to 3. Just a single heating conductor can be carried by the carrier arrangement on the exhaust gas conducting housing for example, or more than two for example differently configured heating conductors can be carried on or in the exhaust gas conducting housing. The heating conductor sections providing a generally wound structure of a respective heating conductor can also have a structure differing from the, for example, meandering structure having a plurality of meandering winding fields that has been described in detail above. Thus, for example, a plurality of heating conductor sections can be arranged as respective meandering winding sections in a manner extending substantially rectilinearly and running parallel next to one another and in this way can cover the entire flow cross section. Furthermore, heating conductor sections can be provided by winding sections, which surround one another in the manner of a winding, of a spiral structure.

Figure 4:
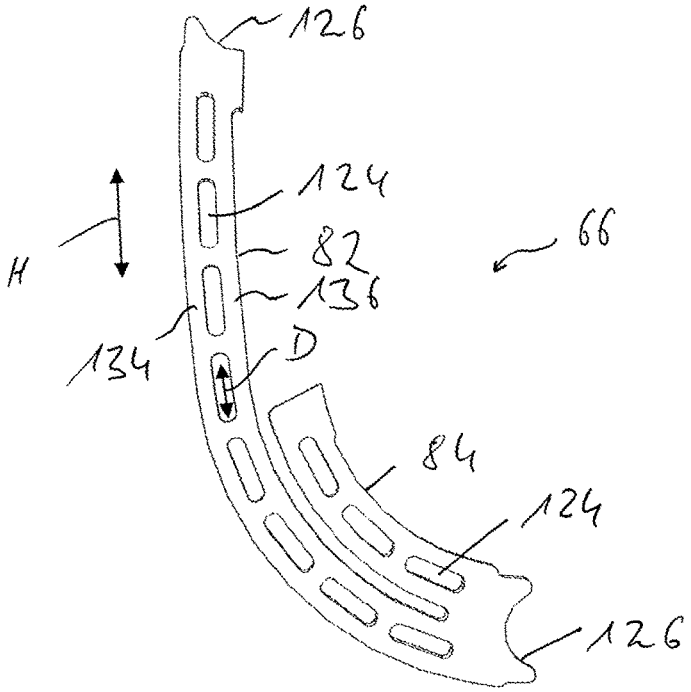
FIG. 4 shows part of a heating conductor configured according to the disclosure.

FIG. 4 shows a portion of a heating conductor, for example the above-described heating conductor 66 of the exhaust gas heating arrangement 120. It should be pointed out that the heating conductor 68 or a possibly single heating conductor of such an exhaust gas heating arrangement could also be formed in an identical or similar way.

It is seen in FIG. 4, in the two heating conductor sections 82, 84 which are illustrated partially or in sections here and which can likewise form meandering winding sections of the heating conductor 66, that a plurality of throughflow openings 124 arranged following one another in a longitudinal direction H of the heating conductor section are provided in these heating conductor sections 82, 84. Each of the throughflow openings 124 can be elongate in a longitudinal direction D of the throughflow opening, which substantially also corresponds to the locally respectively present longitudinal direction H of the heating conductor section.

Various advantages are afforded by the provision of such throughflow openings 124. Firstly, the blocking introduced by such a heating conductor in an exhaust gas system is limited or is reduced in comparison to a configuration without such throughflow openings. Secondly, an enlarged surface area, in which heat can be transmitted to the exhaust gas flowing around such a heating conductor 66, is provided by the surface regions, which border the throughflow openings 124, of the construction material of a respective heating conductor section. In comparison to the surface area lost by the formation of the throughflow openings 124 on the front side and/or rear side of the respective heating conductor 82, 84, this additionally obtained heat transmission surface is larger, the smaller the opening cross-sectional area is in comparison to the thickness of the construction material of the heating conductor 66.

Figure 7:
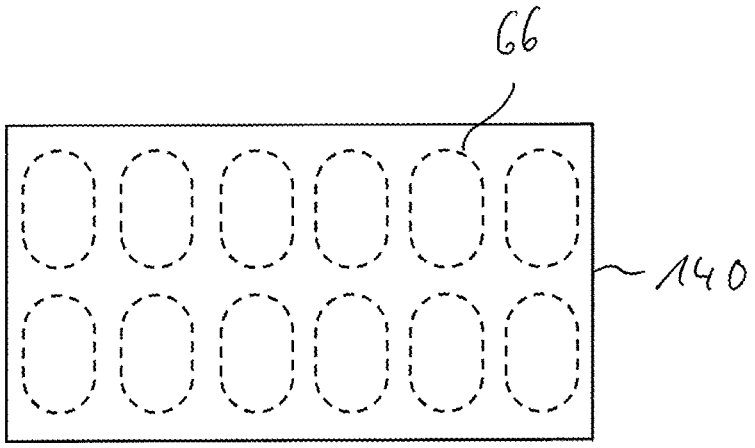

The throughflow openings 124 can be produced, for example, when the heating conductor 66 is produced, for example, from a metal flat material blank 140, illustrated in FIG. 7, by punching. Use can therefore be made of a punching tool which not only punches the contour of the heating conductor 66, but also generates the openings 124. Also when the heating conductor 66 is cut out by cutting, for example laser beam cutting or water jet cutting, the openings 124 can be formed at the same time as the heating conductor 66 is cut out from the metal flat material blank.

In particular whenever the openings 124 have a particularly slender structure or the webs 134, 136 remaining on either side of same in a respective heating conductor section 82, 84 are comparatively narrow, it may be advantageous to separate the operation of cutting out the heating conductor 66 per se and the operation of producing the throughflow openings 124. For example, on the plate-like metal flat material blank 140, first of all wherever respective heating conductors or heating conductor sections are to be produced later, one throughflow opening 124 or a plurality of throughflow openings 124 can be produced in a machining operation, specifically using a machining measure which is particularly suitable taking into consideration the structure to be produced of a respective throughflow opening 124. For example, this cutting out may take place by laser beam cutting or the like. If the throughflow openings 124 have been produced, then, in a further machining operation, the heating conductor or the heating conductors 66 can subsequently be cut out from the metal flat material blank 140, for example by another machining measure, for example, punching. Finishing operations are then no longer required. Of course, this further machining operation could be carried out using the same machining measure, that is, for example, also by laser beam cutting.

Alternatively, it could be provided that first of all individual heating conductors 66 are cut out from the metal flat material blank 140 in order then, in a subsequent machining operation, to produce one or more throughflow openings 124 in various heating conductor sections of a heating conductor 66, the basic structure of which has already been cut out from the blank. In each case particularly suitable machining measures can also be used here for the various machining operations for this purpose, which machining measures may differ from one another but basically may also be identical to one another. In principle, it is also possible, taking into consideration the structure of the individual heating conductor sections or of the throughflow openings to be produced, to produce a portion of the throughflow openings before the heating conductors are cut out from the blank, and to produce a further portion of the throughflow openings after the cutting out, and, for the machining operations, to in each case use the optimum machining measures, which may differ from one another, but basically may also be identical.

It should be pointed out that, in the case of the heating conductor 66 partially illustrated in FIG. 4, at the end regions of the heating conductor section 82 and of the heating conductor section 84 fastening structures 126 are provided, in the region of which the heating conductor 66 or a plurality of such heating conductors consecutively can be fixed on the carrier elements 18, 20 using the insulating elements 108 illustrated in FIG. 2 and the fastening bolts 110. These structures 126 replace the openings 124, which can be seen in FIG. 3 and serve for the same purpose, in regions of the illustrated heating conductor 66 that are assigned to the various fastening regions 106.

Figure 5:
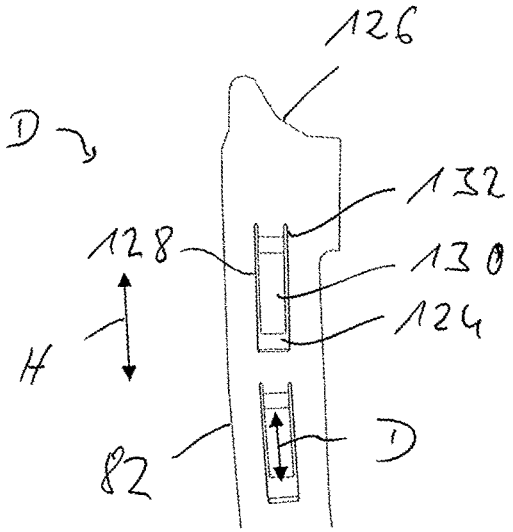
FIG. 5 shows part of a further heating conductor configured according to the disclosure.

An alternative configuration of a heating conductor 66 constructed according to the disclosure is illustrated in FIG. 5. It is seen here that the throughflow openings 124 which can be seen in the heating conductor section 82 are formed, for example, by the formation of a substantially U-shaped incision 128. The formation of such a U-shaped incision 128 results in a tongue-like flow-conducting element 130 which is elongate in the longitudinal direction H of the heating conductor section or in a respective longitudinal direction D of the throughflow opening and is attached as an integral part to the heating conductor 66 or to the heating conductor section 82. The flow-conducting element 130 can be bent out of the plane E, which can be seen in FIG. 6 and is spanned by the heating conductor 66, for example in a downstream direction, such that a defined influence on the flow conduction in the region of such a heating conductor 66 can be provided by such a tongue-like flow-conducting element 130, which is offset with respect to the heating conductor itself or in regions with respect to the plane E.

As an alternative to the attachment, which can be seen in FIG. 5, of a respective flow-conducting element to the heating conductor 66 at the associated throughflow opening 124 in the region of a respective longitudinal end region 132, the attachment could also take place along a longitudinal edge of the associated throughflow opening 124 and a respective flow-conducting element 130 could be bent out of the plane E, by bending about a bending line extending substantially parallel to the longitudinal direction D of the throughflow opening, such that it is arranged offset in the direction of the center axis A of the exhaust gas heater in regions with respect to the plane E or with respect to the heating conductor 66, or is arranged inclined with respect to the plane.

Figure 6:
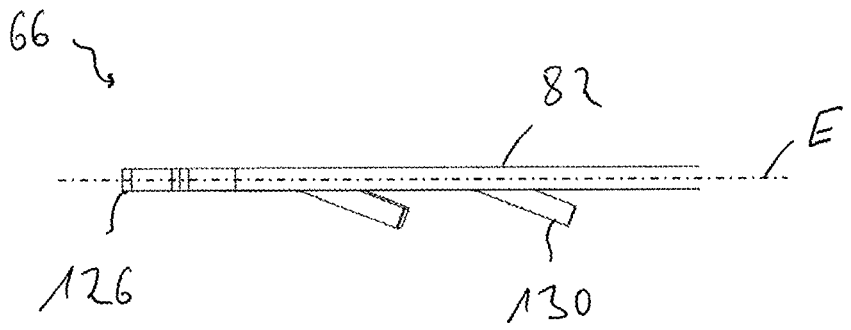
FIG. 6 shows a side view of the heating conductor in FIG. 5 in viewing direction VI in FIG. 5; and, FIG. 7 shows a metal flat material blank with heating conductors to be cut out therefrom.

It should be pointed out that such throughflow openings 124 on the heating conductor 66 can be arranged in all heating conductor sections, that is, also those which are not illustrated in FIGS. 4 to 6, for example with the same distribution or at the same distance from one another and consecutively. Alternatively, depending on the flow conditions to be achieved or adapted to the flow conditions present in an exhaust gas system, the density of the throughflow openings 124 in individual heating conductor sections or between individual heating conductor sections can vary. There can also be heating conductor sections in which no throughflow openings are provided. The throughflow openings 124 can also have different cross-sectional geometries, for example a circular cross-sectional geometry, and they can be positioned, for example, at an angle with respect to the longitudinal direction H of the heating conductor section.

Via the throughflow openings 124 provided in the heating conductor 66, not only is there an influence on the exhaust gas flow, but the current flow through the heating conductor 66 is also affected. In the region of the throughflow openings 124, the current flow is divided between the two webs 134, 136 laterally bounding a respective throughflow opening 124. Depending on the width or the cross-sectional area of the webs 134, 136, the latter may have identical or differing electrical resistances, and therefore, by corresponding dimensioning of the webs 134, 136, the heat generated therein by the respective electrical resistance and thus the energy transmitted to the exhaust gas can also be influenced.

It should furthermore be pointed out that, of course, such throughflow openings can be used in basically differently structured heating conductors of substantially plate-like construction. For example, such a heating conductor could have a spiral structure, wherein individual heating conductor sections can be defined, for example, by respective winding sections of the spiral structure. Also in the case of a meandering profile of the heating conductor sections, the latter can each be constructed in a manner extending substantially rectilinearly and lying next to one another, wherein, in order to adapt the outer circumferential structure of a heating conductor constructed in such a manner to the cross-sectional geometry of a respective exhaust gas conducting housing, the length of the heating conductor sections extending rectilinearly can vary.

It is understood that the foregoing description is that of the preferred embodiments of the invention and that various changes and modifications may be made thereto without departing from the spirit and scope of the invention as defined in the appended claims.

What is claimed is:

1. A heating conductor for an exhaust gas heating arrangement for an exhaust gas system for an internal combustion engine, the heating conductor being configured to be plate-like and being cut out from a metal flat material and comprising:

a plurality of heating conductor sections extending in a heating conductor section longitudinal direction (H), wherein at least one of:

a first portion of said plurality of heating conductor sections are arranged to form a configuration of the heating conductor wound in a meandering manner at least in regions thereof, and, a second portion of said plurality of heating conductor sections form a configuration of the heating conductor wound spirally at least in regions thereof;

at least one throughflow opening provided in at least one of said plurality of heating conductor sections for passing exhaust gas therethrough, said at least one throughflow opening being elongated in a through flow opening longitudinal direction (D) corresponding to said heating conductor section longitudinal direction (H) and having a longitudinal end region; and, a flow-conducting element in association with said at least one throughflow opening, said flow-conducting element being configured to extend, starting from said longitudinal end region, in said through flow opening longitudinal direction (D) at least partially along said throughflow opening.

2. The heating conductor of claim 1, wherein selected ones of said plurality of heating conductor sections define throughflow openings for passing exhaust gas therethrough.

3. The heating conductor of claim 1, wherein said plurality of heating conductor sections define respective throughflow openings therein for passing exhaust gas therethrough.

4. The heating conductor of claim 1, wherein, at said throughflow opening, said flow-conducting element is offset at least in regions with respect to said heating conductor.

5. An exhaust gas heating arrangement for an exhaust gas system for an internal combustion engine, the exhaust gas heating arrangement comprising:

an exhaust gas conducting housing for conducting a flow of exhaust gas in a main flow direction; a carrier arrangement held in said exhaust gas conducting housing;

at least one heating conductor mounted on said carrier arrangement; said at least one heating conductor being configured to be plate-like and being cut out from a metal flat material and comprising:

a plurality of heating conductor sections extending in a heating conductor section longitudinal direction (H), wherein at least one of:

a first portion of said plurality of heating conductor sections are arranged to form a configuration of the at least one heating conductor wound in a meandering manner at least in regions thereof, and, a second portion of said plurality of heating conductor sections form a configuration of the at least one heating conductor wound spirally at least in regions thereof;

at least one throughflow opening provided in at least one of said plurality of heating conductor sections for passing exhaust gas therethrough, said at least one throughflow opening being elongated in a through flow opening longitudinal direction (D) corresponding to said heating conductor section longitudinal direction (H) and having a longitudinal end region;

a flow-conducting element in association with said at least one throughflow opening, said flow-conducting element being configured to extend, starting from said longitudinal end region, in said through flow longitudinal direction (D) at least partially along said throughflow opening.

6. The exhaust gas heating arrangement of claim 5, wherein said at least one heating conductor comprises plurality of heating conductors following one another in said main flow direction.

7. An exhaust gas system for an internal combustion engine, the exhaust gas system comprising:

an exhaust gas heating arrangement including:

an exhaust gas conducting housing for conducting a flow of exhaust gas in a main flow direction;

a carrier arrangement held in said exhaust gas conducting housing;

at least one heating conductor mounted on said carrier arrangement; and, said at least one heating conductor being configured to be plate-like and being cut out from a metal flat material and comprising:

a plurality of heating conductor sections extending in a heating conductor section longitudinal direction (H), wherein at least one of:

a first portion of said plurality of heating conductor sections are arranged to form a configuration of the at least one heating conductor wound in a meandering manner at least in regions thereof, and, a second portion of said plurality of heating conductor sections form a configuration of the at least one heating conductor wound spirally at least in regions thereof;

at least one throughflow opening provided in at least one of said plurality of heating conductor sections for passing exhaust gas therethrough, said at least one throughflow opening being elongated in a through flow opening longitudinal direction (D) corresponding to said heating conductor section longitudinal direction (H) and having a longitudinal end region;

a flow-conducting element in association with said at least one throughflow opening, said flow-conducting element being configured to extend, starting from said longitudinal end region, in said through flow longitudinal direction (D) at least partially along said throughflow opening.

8. The exhaust gas system of claim 7, wherein said at least one heating conductor comprises plurality of heating conductors following one another in said main flow direction.

* * * * *